US006454906B1

(12) United States Patent
Nonomura et al.

(10) Patent No.: US 6,454,906 B1
(45) Date of Patent: Sep. 24, 2002

(54) PROCESS FOR PRODUCING PULP MOLDED ARTICLE

(75) Inventors: Akira Nonomura; Atsushi Sato; Tokuo Tsuura; Yasushi Yamada; Hiroaki Kobayashi; Shingo Odajima; Tokihito Sono, all of Tochigi-ken (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/503,083

(22) Filed: Feb. 14, 2000

(30) Foreign Application Priority Data

Feb. 18, 1999 (JP) ..... 11-040523
Feb. 18, 1999 (JP) ..... 11-040524

(51) Int. Cl.[7] ..... D21J 7/00
(52) U.S. Cl. ..... 162/220; 162/401; 264/87
(58) Field of Search ..... 162/218, 220–224, 162/226–228, 387–390, 396, 397, 401, 402, 405, 407–409; 425/84, 388, 529, 530; 419/36; 249/65, 113; 264/299, 301, 306, 313, 315, 319, 86, 87, 40.3, 40.5

(56) References Cited

U.S. PATENT DOCUMENTS

| | | | | | |
|---|---|---|---|---|---|
| 240,091 | A | * | 4/1881 | Chase | 162/220 |
| 293,220 | A | * | 2/1884 | Bodge | 162/220 |
| 1,324,935 | A | * | 12/1919 | Sims | 162/220 |
| 2,025,053 | A | * | 12/1935 | Heymann et al. | 162/218 |
| 2,961,043 | A | | 11/1960 | Hicks | 162/401 |
| 3,250,668 | A | * | 5/1966 | Modersohn | 162/220 |
| 4,123,307 | A | * | 10/1978 | Lemelson | 156/172 |
| 4,132,591 | A | * | 1/1979 | Merges, Jr. | 162/146 |
| 4,900,487 | A | * | 2/1990 | Lalloz et al. | 264/45.2 |
| 5,194,212 | A | * | 3/1993 | Bonnett | 264/513 |

FOREIGN PATENT DOCUMENTS

| | | | |
|---|---|---|---|
| DE | 960 410 | 3/1957 | |
| FR | 606235 | 6/1926 | |
| GB | 469882 | 8/1937 | D21J/3/00 |
| JP | 35-9669 | 7/1960 | |
| JP | 5-156600 | 6/1993 | D21J/3/00 |
| JP | 7-223230 | 8/1995 | B29C/43/10 |

OTHER PUBLICATIONS

T. Goto, Public Relations Department, Kao Corporation, 4 pages, "Paper–Bottle Molding System", Oct. 25, 2000 (with English Translation).

* cited by examiner

*Primary Examiner*—Peter Chin
*Assistant Examiner*—Eric Hug
(74) *Attorney, Agent, or Firm*—Oblon, Spivak, McClelland, Maier & Neustadt, P.C.

(57) ABSTRACT

A process for producing a pulp molded article comprising inserting a hollow inflatable pressing member 81 which has been made small so as to have smaller cross-sectional contour into a cavity 4 of a mold 1 in which a pulp layer 7 has been formed, and feeding a pressurizing fluid into the inserted pressing member 81 to inflate the pressing member 81 thereby to press the pulp layer 7 onto the inner wall of the cavity 4.

21 Claims, 5 Drawing Sheets

1
3
2
5
7a
6
4
7
8
81
82
5
9c
9b
9d
83
20
21
22
23

PROCESS FOR PRODUCING PULP MOLDED ARTICLE

BACKGROUND OF THE INVENTION

The present invention relates to a process for producing pulp molded articles. More particularly, it relates to a process for producing pulp molded articles which is suitable to production of hollow molded articles having an opening whose cross-sectional area is smaller than that of their bodies.

Pulp molded articles have been produced by a process in which a pair of split molds comprising a male mold and a female mold are used and pulp slurry is charged between the pair of split molds followed by dehydrating the pulp slurry to form shallow trays, plates, etc. or a process in which a pair of split molds are used to mold two split molds which are combined together to form a hollow molded article such as a bottle.

In the process using a male mold and a female mold, it is not easy to produce molded articles of complicated shape such as undercut containers. In the process comprising combining split parts, the butt-seam which appears on the surface impairs the strength and appearance of molded articles, and it is not easy to produce hollow molded articles having a smaller cross-sectional area at the opening than that in the body.

Separately, production of pulp molded articles further includes a step of dehydrating the water-containing pulp layer formed by a paper making technique for improving handling properties and for reducing the drying time. Known methods of dehydration include a method comprising pressing a pulp layer by use of an elastic member as described in Japanese Patent Application Laid-Open No. 156600/93 and a method comprising pressing a pulp layer by use of a flexible film as disclosed in Japanese Patent Application Laid-Open No. 223230/95.

In these methods of dehydration, when the pressing force is increased in order to decrease the water content of a wet pulp layer, a paper making net bites the pulp layer to leave its trace on the surface of the pulp molded article, which deteriorates the appearance of the molded article. Besides, a large-sized apparatus is required to increase the pressing force. Further, since the degree of dehydration achieved by mechanical manipulation is limited, a long time would be required to reduce the water content to a satisfactory level, showing poor dehydration efficiency.

The pulp layer having been dehydrated so as to have a prescribed water content (hereinafter referred to as a preform) is removed from the paper making mold and dried by heating in a heating mold. The lower the water content of the preform, the shorter the required drying time in the heating mold.

However, in case where a preform is to be shaped while dried in a heating mold, the shape of the inner wall of the mold sometimes fails to be precisely transferred to a preform with too low a water content due to insufficient mobility of the pulp fiber. In particular, it is difficult to transfer the shape of threads or impressions for making letters, figures, symbols, etc. in relief.

SUMMARY OF THE INVENTION

Accordingly, an object of the present invention is to provide a process for producing pulp molded articles of complicated shape and free from a butt-seam.

Another object of the invention is to provide a process for easily producing hollow pulp molded articles having a smaller cross-sectional area at the opening than that in the body.

Still another object of the invention is to provide a process for producing pulp molded articles in which a pulp layer can be dehydrated at high efficiency with a simple apparatus without leaving the trace of a paper making net on the surface of the molded articles.

Yet another object of the invention is to provide a process for producing pulp molded articles in which a water-containing preform can be dried at improved efficiency while the shape of the inner wall of a mold can be transferred with satisfactory precision.

The above objects are accomplished by a process for producing a pulp molded article having an opening which comprises forming a pulp layer on the inner wall of a mold cavity and drying the pulp layer, wherein a hollow inflatable pressing member which has been made small so as to have smaller cross-sectional contour than that of the portion of the pulp layer corresponding to the opening of the pulp molded article is inserted into the mold cavity after the pulp layer is formed, and a pressurizing fluid is fed to the inside of the inserted pressing member to inflate the pressing member thereby to press the pulp layer onto the inner wall of the cavity.

BRIEF DESCRIPTION OF THE DRAWINGS

FIG. 1 schematically illustrates the steps of forming and dehydrating a pulp layer in a first embodiment of the present invention, wherein

FIG. 6 displays the step of dehydrating in a fifth embodiment of the present invention, wherein

FIG. 8 schematically shows the step of dehydration in a sixth embodiment of the present invention, wherein

DETAILED DESCRIPTION OF THE PREFERRED EMBODIMENTS

Figures 1A, 1B, 1C, 1D, 1E:
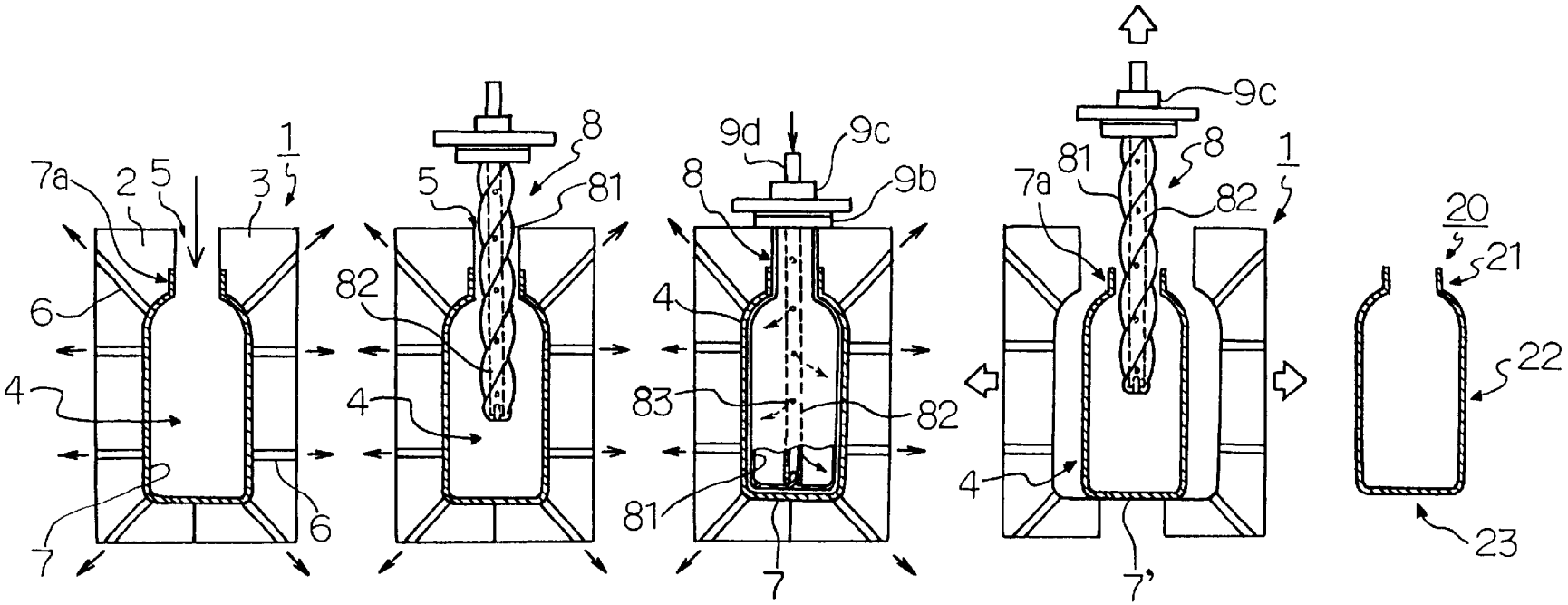
FIG. 1A shows the step of forming a pulp layer.
FIG. 1B, the step of inserting a pressing member.
FIG. 1C, the step of pressing and dehydrating.
FIG. 1D, the step of opening the mold and removing the preform from the mold.
FIG. 1E, a cross sectional view of the resulting pulp molded article.

The process for producing pulp molded articles according to the present invention will be described chiefly based on preferred embodiments thereof with reference to the accompanying drawings. A first embodiment presents a process for producing hollow molded articles having the shape of a bottle with an opening whose diameter is smaller than the body's. Of the steps constituting the process, FIG. 1 illustrates the steps of forming and dehydrating a pulp layer for preparing a pulp preform wherein FIG. 1A shows the step of forming a pulp layer; FIG. 1B, the step of inserting a pressing member; FIG. 1C, the step of pressing and dehydrating; and FIG. 1D, the step of opening the mold and removing the preform from the mold.

In the first embodiment, two split molds for a paper making are mated to form a cavity of prescribed shape, and a pulp slurry is fed into the cavity to form a pulp layer (undehydrated preform) on the cavity wall. A pressing member is inserted in the preform and a prescribed pressurizing fluid is fed into the inside of the pressing member to inflate the pressing member, whereby the wet preform is pressed by the inflated pressing member onto the cavity wall and dehydrated.

In FIG. 1A, two split molds 2 and 3 are butted to make a mold 1 having a cavity 4 of prescribed shape. In this state, a slurry flow channel 5 is formed at the upper part of the mold 1, which connects the cavity 4 and the outside of the mold 1 and through which a pulp slurry is to be charged. Each of the split molds 2 and 3 has a plurality of conduits 6 connecting the cavity 4 and the outer surface. The inner wall of each split molds 2, 3 is covered with net having a prescribed mesh size (not shown).

A pulp slurry is charged into the cavity 4 through the slurry flow channel 5, and the cavity 4 is evacuated by suction from the outside of split molds 2, 3 through the conduits 6 to thereby suck the water content of the slurry and to build up pulp fibers on the net covering the inner wall of the cavity 4. As a result, a pulp layer 7 made up of pulp fibers is formed on the net. The pulp layer 7 has an opening 7*a* corresponding to the opening of a finished pulp molded article in the vicinity of the slurry flow channel 5 of the mold 1. The opening 7*a* has a circular cross section.

After a prescribed amount of the pulp slurry is charged into the cavity 4, the feed is stopped, and the cavity 4 is completely dehydrated by suction. Subsequently, a pressurizing means 8 is inserted through the slurry flow channel 5 into the cavity 4 while evacuating the cavity 4 as shown in FIG. 1B.

The pressurizing means 8 has an pressing member 81 and a supporting member 82 which is inserted in the pressing member 81. Before the pressurizing means 8 is inserted into the cavity 4, the pressing member 81 is twisted around the supporting member 82 so as to make the cross-sectional contour of the pressurizing means 8 smaller that that of the opening 7*a*, and the pressurizing means 8 in its twisted state is inserted into the cavity 4.

Figure 2A:
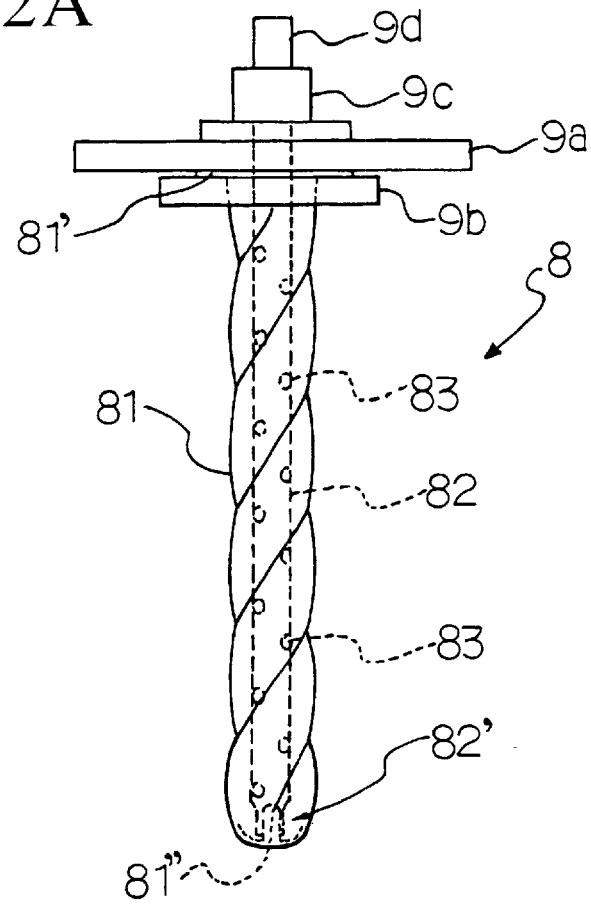
FIG. 2A is a side view of the pressing member used in the first embodiment.
Figure 2B:
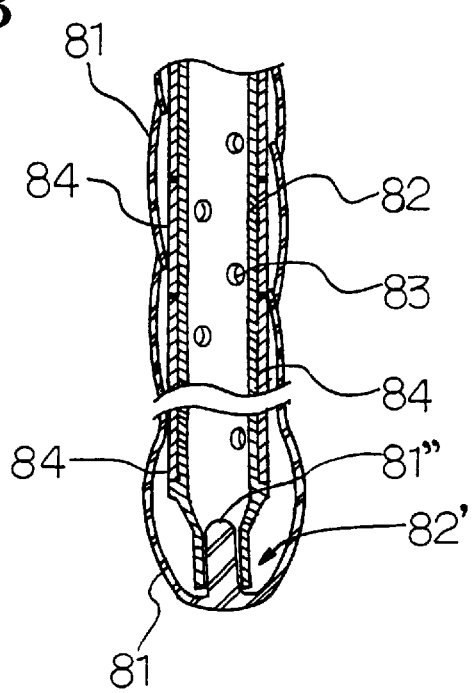
FIG. 2B is an enlarged cross sectional view of the main part in FIG. 2A.

FIGS. 2A and 2B show the side view of the pressurizing means 8 and its enlarged cross-sectional view, respectively. The pressing member 81 is an inflatable hollow bag and has a flange 81' at the open top, which is clamped between an upper holding plate 9*a* and a lower holding plate 9*b* to fix the pressing member 81.

The pressing member 81 is made of an inflatable material. The term "inflatable" as used herein means that (1) the material elastically stretches to change its capacity and (2) the material itself is not stretchable but is flexible so that it is capable of changing its capacity: with a fluid fed inside thereof or a fluid discharged. The former pressing member is made of an elastic material such as natural rubber, urethane rubber, fluororubber, silicone rubber and elastomers. The latter pressing member can be of flexible materials such as plastic materials (e.g., polyethylene and polypropylene), a film of these plastic materials having aluminum or silica deposited thereon, a film of these plastic materials having aluminum foil laminated thereon, paper and fabric.

It is preferred for the pressing member 81 to have air permeability as well as inflatability. For the pressing member 81 to be air permeable improves efficiency in pressing, dehydration, and heat-drying of the pulp layer 7 as hereinafter described in detail. A preferred degree of air permeability of the pressing member 81 is 5 to 5,000 seconds, particularly 10 to 500 seconds, as measured in accordance with JIS P8117. With such a degree of air permeability, dehydration by pressing and dehydration by air passage will be in good balance to achieve efficient dehydration. The above specified degree of air permeability is equal to that measured according to JIS L1096 with the amount of air flow being set at 100 ml. The pressing member 81 having air permeability and inflatability includes ones made of elastically stretchable fabric, made of elastically stretchable fabric lined with an elastically stretchable material, made of a fabric or paper having no elastic strechability, made of a perforated plastic film, and made of a porous plastic film.

The pressing member 81 used in this particular embodiment is made of an elastic, expansible, contractible and air-permeable material.

The supporting member 82 is a cylindrical pipe having a large number of holes 83 in its side wall as shown in FIGS. 2A and 2B. The pipe supporting member 82 has a large number of annular guide idlers 84 loosely fitted therearound with certain clearance between the supporting member 82 and the annular guide idlers 84 enough to allow the annular guide idlers 84 to rotate.

As shown in FIG. 2A, the supporting member 82 has its lower end 82' opened. The pressing member 81 has a projection 81" of prescribed shape at the bottom of the inner side thereof, and the projection 81" is fitted into the opening of the lower end 82' so that the bottom of the pressing member 81 is fixed to the lower end 82' of the supporting member 82. It is preferred for the projection 81" to have an elliptic or polygonal cross-section rather than a circular one so as to increase the torque on rotation. The upper end of the supporting member 82 is also open. The open upper end is connected to one end of an annular joint 9*c* which is fixed to the upper holding plate 9*a* through a ball bearing (not shown). The joint 9*c* is connected to a driving means (not shown) such as a motor so that the joint 9*c* is rotatable on its own axis. The other end of the joint 9*c* is connected via a ball bearing (not shown) to a connector 9*d* which is used for feeding a pressurizing fluid described later. Thus, there is formed a conduit for a pressurizing fluid to flow from the connector 9*d* through the joint 9*c* and the inside of the supporting member 82 to the holes 83.

In twisting the pressing member 81 around the supporting member 82, the joint 9*c* is rotated by the driving means mentioned above. Directly connected to the joint 9*c*, the supporting member 82 also rotates with the rotating joint 9*c*, but the connector 9*d*, connected to the joints 9*c* via a ball bearing, does not rotate. On the other hand, since the pressing member 81 has its flange 81' clamped between the upper and lower holding plates 9*a* and 9*b* and the inner side of its bottom fixed to the lower end 82' of the supporting member 82, it is twisted as the supporting member 82 rotates. Because there are annular guide idlers 84 fitted around the supporting member 82 with clearance, the pressing member 81 is twisted as guided along the surface of the annular guide idlers 84. While the pressing member 81 is being twisted, the annular guide idlers 84, which are freely rotatable, do not rotate with the rotation of the supporting member 82 but idles. As a result, the pressing member 81 is twisted very smoothly from its bottom fixed to the supporting member 82 as a starting point. About 2 to 2.5 turns of the supporting member 82 suffice to give twists to the pressing member 81 around the supporting member 82, while times of turn depend on the shape and size of the pressing member 81 and the supportive member 82.

With the pressing member 81 twisted around the supporting member 82, the cross-sectional contour of the pressurizing means 8 is made smaller than that of the opening 7*a*. It is preferred that the pressing member 81 be evacuated by suction to make the pressurizing means 8 still smaller. The pressurizing means 8 having the thus reduced cross-sectional size can be inserted into the cavity 4 without touching the pulp layer 7*a* at the opening 7*a* so that the pulp built up on the opening 7*a* is prevented from falling off. In order to improve durability of the pressurizing means 8, it is desirable for the pressing member 81 as untwisted and inflated to be substantially as large as or slightly larger than the cavity 4 so that the pressing member 81 can press the pulp layer 7 at a reduced stretch ratio.

Back to FIG. 1, the pressurizing means 8 is inserted into the cavity 4 whereby the slurry flow channel 5 is closed by the lower holding plate 9*b* as shown in FIG. 1C. In this state, the joint 9*c* is reversed to untwist the pressing member 81. At the same time, a prescribed pressurizing fluid is fed to the inside of the supporting member 82 from its source through the connector 9*d*. The pressurizing fluid passes through the holes 83 formed on the side wall of the supporting member 82, the clearance between the supporting member 82 and the annular guide idlers (not shown), and the gaps between adjacent annular guide idlers and released into the inside of the pressing member 81. Simultaneously with the feed of the pressurizing fluid, the inside of the split molds 2, 3 is evacuated by suction from the outside thereby inflating the pressing member 81. The inflated pressing member 81 presses the pulp layer 7 toward the wall of the cavity 4. The large number of the holes 83 made in the wall of the supporting member 82 are effective in inflating the pressing member 81 all over simultaneously thereby pressing the pulp layer 7 to the cavity wall uniformly. The inflated pressing member 81 becomes a figure similar to that of the cavity 4. The pressurizing fluid which can be used to inflate the pressing member 81 includes compressed air (heated air), oil (heated oil), and other various liquids. From the standpoint of operating convenience, it is preferable to use air, hot air, vapor or superheated vapor. The pressurizing fluid is preferably fed under a pressure of 0.01 to 5 MPa, particularly 0.1 to 3 MPa.

While the inflated pressing member 81 is pressing the pulp layer 7, the pulp layer 7 takes the shape of the cavity 4, and dehydration of the pulp layer 7 proceeds. Since the pulp layer 7 is pressed from the inside toward the inner wall of the cavity 4, the shape of the cavity 4 can be transferred to the pulp layer 7 with high precision however complicated it may be. Since the shape of the inflated pressing member 81 is similar to that of the cavity 4 as stated above, the pulp layer 7 is pressed under practically the same pressure in every portion thereof to have a uniform wall thickness. Unlike the conventional process for producing hollow pulp molded articles, there is no need to combine two split parts. The resulting pulp molded articles have therefore no butt-seams nor non-uniformity of wall thickness. Thus, the resulting pulp molded articles have increased strength and an improved outer appearance.

Where the pressing member 81 is air-permeable, the pulp layer 7 can be dehydrated at sufficiently high efficiency even under a low pressing force as compared with a pressing member having no air-permeability. As a result, the scale of apparatus can be made small, and the paper-making net hardly leaves its trace on the surface of the pulp layer 7. Where a heated fluid is used as a pressurizing fluid to be fed into the pressing member 81, mechanical dehydration and dehydration by heat-exchanging aeration can be carried out simultaneously, bringing about markedly improved dehydration efficiency.

On sufficiently transferring the shape of the cavity 4 to the pulp layer 7 and reducing the water content of the pulp layer 7 to a prescribed one, the pressurizing fluid is withdrawn from the pressing member 81 as shown in FIG. 1D. At the same time, the joint 9*c* is rotated to rotate the supporting member 82 and to give twists to the pressing member 81 around the supporting member 82. It follows that the pressing member 81 returns to the initial twisted state. The pressurizing means 8 with its pressing member 81 twisted is taken out of the cavity 4. Since the pressurizing means 8 is of the same size as before being inserted into the cavity 4, it can be taken out without scraping the opening 7*a* so that falling-off of the pulp of the opening. 7*a* can be prevented. Simultaneously with the removal of the pressurizing means 8, the mold 1 is opened to take out a wet pulp preform 7' having a prescribed water content.

The preform 7' is then sent to a heating and drying step. The heating and drying step is carried out in the same manner as in the steps for preparing the preform shown in FIG. 1, except that the steps of forming a pulp layer and dehydrating the pulp layer are not conducted and that a heated split mold is used. That is, two split molds, which are to be butted to form a cavity in accordance with the outer contour of the desired pulp molded articles, are heated to a prescribed temperature to give a heating mold. The wet preform is set in the cavity of the heating mold, a pressing member similar to the above-described pressurizing means 8 is inserted as twisted in the same manner, the pressing member is inflated to press the preform to the inner wall of the heated mold to heat and dry the preform, and the resulting pulp molded article is take out of the mold.

Where the pressing member 81 used in the heating and drying step has air-permeability as in the above-described step of pressing and dehydration, through flow drying can be effected efficiently to achieve improved drying efficiency. In particular, where a heated fluid such as hot air and superheated vapor is fed into the pressing member, through flow drying by heat exchange can be conducted more efficiently to further improve the drying efficiency.

As shown in FIG. 1E, a pulp molded article 20 thus obtained is a bottle-shaped cylindrical hollow article comprising a mouth 21, a body 22, and a bottom 23, with the cross-sectional area of the mouth 21 being smaller than that of the body 22. Such a pulp bottle is useful as a container for a variety of contents. The pulp molded article 20 has an almost right angle between the bottom 23 and the body 22 and can have a height of 50 mm or more. preferably 100 mm or more. Notwithstanding that the container is so deep and the cross-sectional area of the mouth 21 is so small, the pulp molded article 20 as produced by the process of the present invention suffers from no fall-off at the inner side of its mouth 21 and has no seam on its body 22. Further, the pulp molded article 20 has a smooth surface on both the outer and inner surfaces. For example, the inner and outer surfaces could have a center-line average surface roughness (Ra) of 50 μm or less and a maximum of roughness (Ry) of 500 μm or less as measured in accordance with JIS B0601.

In case where the pressing member 81 is air-permeable, it is possible to lower the pressing force so that the resulting pulp molded article has an extremely excellent appearance, bearing no or, if any, imperceptible traces of the net.

The second to seventh embodiments of the present invention will be described with reference to FIGS. 3 through 9. The details of the first embodiment appropriately apply to the particulars of the second to seventh embodiments that are not described here. The members in FIGS. 3 to 9 that are the same as those in FIGS. 1 and 2 have the same reference numerals as in the latter.

In the second and the third embodiments, the wet pulp layer as formed by paper making is pressed and dehydrated in such a manner that a prescribed part of the resulting preform may have a higher water content than the other part.

Figure 3:
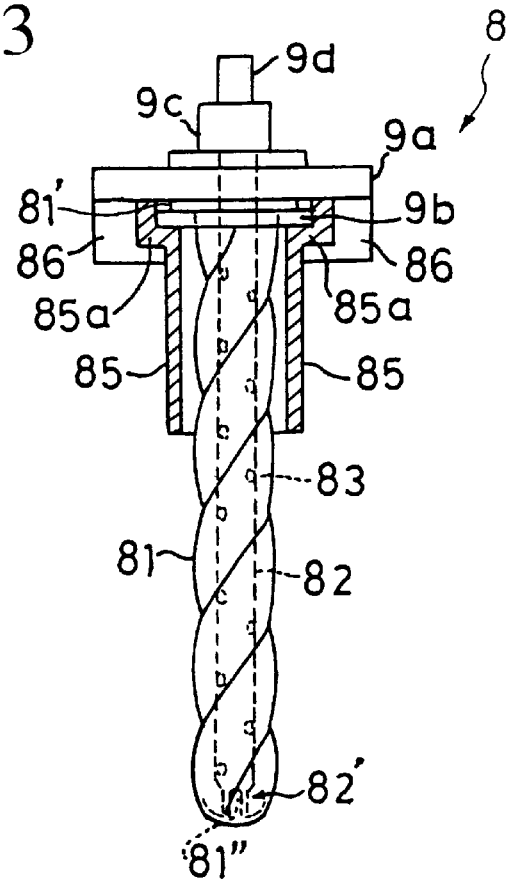
FIG. 3 (corresponding to FIG. 2A) schematically shows the structure of a pressing member used in a second embodiment of the present invention.

In the second embodiment, a pressurizing means 8 shown in FIG. 3 is used. The pressurizing means 8 shown comprises an pressing member 81, a supporting member 82 that is inserted inside the pressing member 81, and a rigid protecting member 85 which surrounds the upper part of the pressing member 81.

The protecting member 85 is a cylinder with its flange 85*a* fitted to the lower surface of the upper holding plate 9*a* by a fixing member 86. The inner diameter of the protecting member 85 is larger than the outer diameter of the twisted pressing member 81 and smaller than the inner diameter of the opening 7*a* of the pulp layer 7 formed on the inner wall of the mold 1. The height of the protecting member 85 is designed so that it may face the opening 7*a* of the pulp layer 7 after the pressurizing means 8 is inserted into the inside of the pulp layer 7. The protecting member 85 is made of a metal, a resin, etc. Specifically, it is formed of a hardly stretchable material having high tensile strength and high elastic modulus, such as urethane, rubber and silicone.

Figure 4:
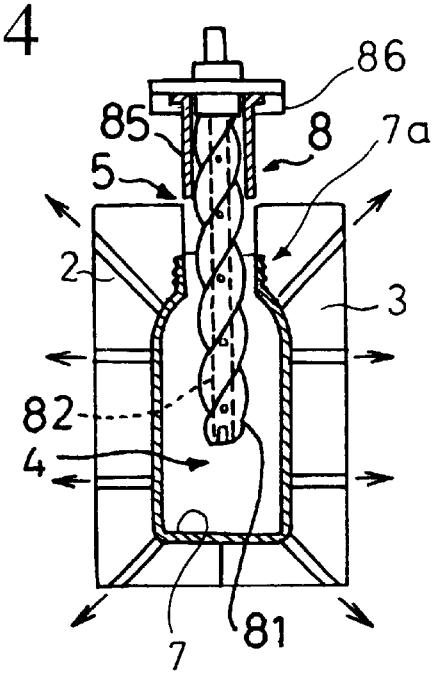
FIG. 4 (corresponding to FIG. 1B) schematically illustrates the step of pressing and dehydrating a pulp layer by use of the pressing member shown in FIG. 3.

The pressurizing means 8 shown in FIG. 3 is inserted inside the pulp layer 7 formed by paper making as shown in FIG. 4. Because the protecting member 85 surrounds the upper periphery of the pressing member 81, the pressing member 81 can be inserted without touching the inner wall of the opening 7*a* and without scraping the pulp.

With the pressurizing means 8 inserted inside the pulp layer 7, the slurry flow channel 5 of the mold 1 is closed by the fixing member 86. In this state, the protecting member 85 is positioned to face the opening 7*a* of the pulp layer 7 with certain clearance formed between the protecting member 85 and the opening 7*a*. A prescribed pressurizing fluid is then fed from its source inside the pressing member 81. Simultaneously with the feed of the pressurizing fluid, the inside of the split molds 2, 3 is evacuated by suction from the outside, whereby the pressing member 81 is inflated to press the pulp layer 7 toward the inner wall of the cavity 4. Meanwhile, the opening 7*a* is protected by the protecting member 85 from being pressed by the pressing member 81.

The pulp layer 7 is pressed all over the portions except for the opening 7*a* under practically the same pressure. The pressing force imposed on the opening 7*a* is less than that on the other portions of the pulp layer 7. It follows that the resulting preform has a higher water content in its opening 7*a* than in the other part. The preform has a uniform wall thickness except for the opening 7*a* In this embodiment, it is preferred for the opening 7*a* of the preform to have a water content of 65 to 80% by weight, particularly 70 to 75% by weight, in view of the balance between shape retention of the opening 7*a* and shapability of this part in the subsequent heating and drying step. As for the parts of the preform other than the opening 7*a*, a preferred water content is 40 to 70% by weight, particularly 55 to 65% by weight, in order to secure improved appearance free from the traces of the net of the surface of the preform and improved efficiency in the subsequent step of heating and drying.

The pressed and dehydrated preform is then subjected to drying by heating. The heating and drying step in the second embodiment uses the same pressing member as used in the step of pressing and dehydration, except that the pressing member used in this step does not have a protecting member. In other words, the preform 7 is pressed in every portion thereof, unlike in the step of pressing and dehydration. Since the opening 7*a* has a higher water content than the other part, the pulp fibers in this part is so movable that the surface profile of the corresponding mouth of the heating mold, for example, threads, can be transferred to this part with precision while the pulp layer 7 is being pressed onto the cavity wall by the pressing member. The other part except the opening 7*a*, on the other hand, is rapidly dried because of its water content previously reduced to a predetermined degree in the step of pressing and dehydration. Thus, the second embodiment is advantageous for improving the efficiency in drying a wet preform and for improving reproducibility of the complicated shape of the inner surface of the mold.

Third embodiment uses a pressing member having no protecting member, which is different from the second embodiment. Instead of a protecting member, the pressing member 81 used in the third embodiment is made thicker in its part corresponding to the opening 7*a* than in the other parts. That is, when a pressurizing fluid is fed into the pressing member 81, which presses the opening 7*a* of the pulp layer 7, the part corresponding to the opening 7*a* is less inflatable than the other parts because of its larger thickness. As a result, the part corresponding to the opening 7*a* imposes a weaker pressing force onto the opening 7*a* than on the other parts of the pressing member 81, and the resulting preform has a higher water content in the opening 7*a* than in the other parts. The preferred water contents of the opening 7*a* and the other parts of the preform as described with respect to the second embodiment also apply to the third embodiment.

While in the second and third embodiments the cross-sectional contour of the pressing member 81 is made smaller than that of the opening 7*a* by twisting the pressing member 81 around the supporting member 82, it is possible to make the cross-sectional contour of the pressing member 81 smaller than that of the opening 7*a* by other means, for example, the means as adopted in the fourth and the fifth embodiments hereinafter described.

Figure 5:
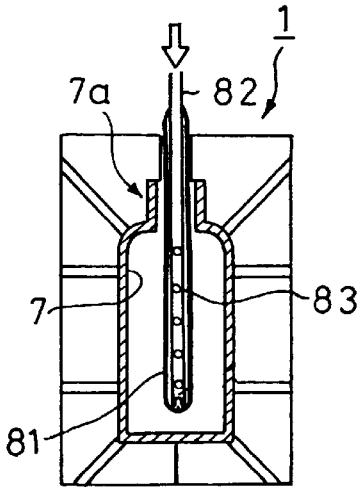
FIG. 5 (corresponding to FIG. 1B) illustrates the step of inserting a pressing member in a fourth embodiment of the invention.

In the fourth embodiment, the cross-sectional contour of the pressing member is made smaller than that of the opening of the pulp layer corresponding to the opening of a finished pulp molded article by evacuating the pressing member by suction. As shown in FIG. 5, this embodiment is preferably achieved by inserting a supporting member 82 comprising a cylindrical pipe into a pressing member 81, fixing a prescribed part of the pressing member 81 to a prescribed part of the supporting member 82 to thereby support the pressing member 81 by the supporting member 82, and evacuating the pressing member to make it smaller. The pressing member 81 can thus be inserted into the cavity 4 in stable manner.

The supporting member 82 has a large number of holes 83 in its wall as shown in FIG. 5. A pressurizing fluid is fed into the inside of the supporting member 82 through the holes 83 when the pressurizing means 8 presses the pulp layer 7 and released into the inside of the pressing member 81. Fixing of the pressing member 81 to the supporting member 82 is carried out in the same manner as in the first embodiment.

Figure 6A:
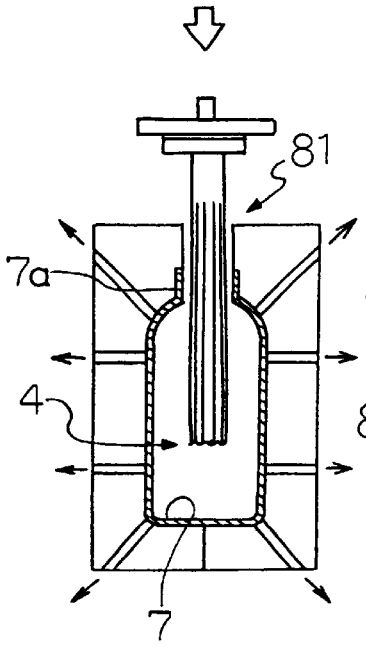
FIG. 6A shows the step of inserting a pressing member.

In the fifth embodiment, the cross-sectional contour of the pressing member is made smaller than that of the opening of the pulp layer by folding or pleating the pressing member in a prescribed manner. After formation of the pulp layer 7, a pressing member 81 which is folded to have a smaller cross-sectional contour than that of the opening 7*a* is inserted into the cavity 4 in its folded state while evacuating the cavity 4 by suction as shown in FIG. 6A. While being inserted, the pressing member 81 is preferably evacuated by suction to make its cross-sectional contour still smaller. In this particular embodiment, the pressing member 81 is pleated to make a number of folds along the insertion direction when it is inserted into the cavity 4.

Figure 7A:
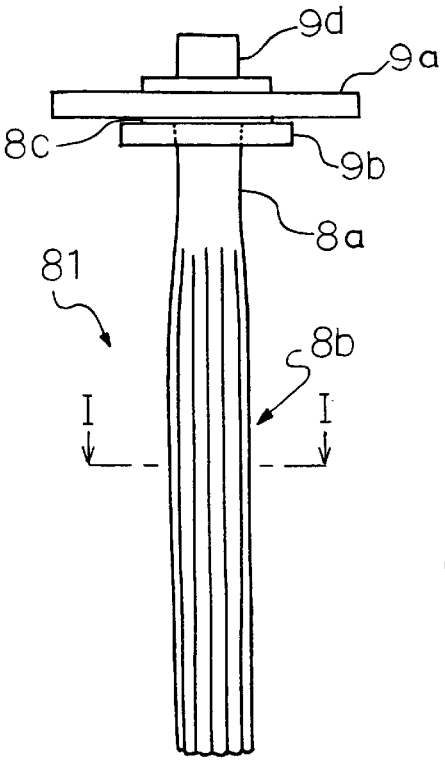
FIG. 7A is a side view of the pressing member used in the fifth embodiment.
Figure 7B:
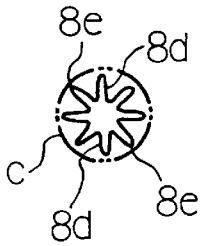
FIG. 7B is a cross sectional view of the pressing member of FIG. 7A taken along line I—I.

FIGS. 7A and 7B show the side view of the pressing member 81 used in the fifth embodiment and its cross sectional view taken along line I—I, respectively. The pressing member 81 is a hollow inflatable bag composed integrally of a tubular portion 8*a* and a pleated portion 8*b*, with the tip of the tubular portion 8*a* leading to the outside. The tip of the tubular portion 8*a* has a flange 8*c* in the periphery thereof, which is clamped between an upper holding plate 9*a* and a lower holding plate 9*b* to fix the pressing member 81. The upper holding plate 9*a* has a connector 9*d* which is used for feeding a pressurizing fluid. A pressurizing fluid is fed into the pressing member 81 through the connector 9*d*.

As depicted in FIG. 7B, the cross-sectional contour of the pleated portion 8*b* has eight radial pleats, the folds 8e of which are circumscribed in circle C drawn in a broken line. The circle C has a smaller diameter than the circle of the cross-sectional contour of the opening 7*a*. Thus, the pressing member 81 can be inserted into the cavity 4 without touching the opening 7*a* so that the pulp layer of the opening 7*a* is prevented from falling off.

Figure 6B:
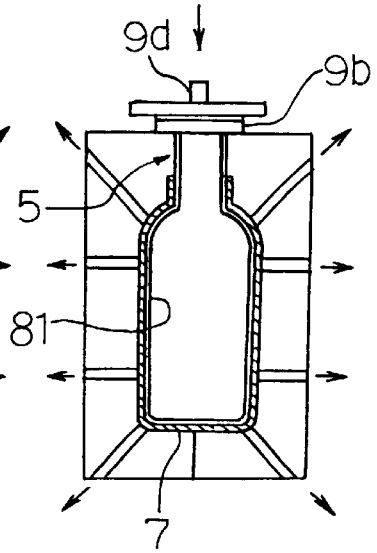
FIG. 6B, the step of pressing and dehydration.

The pressing member 81 as pleated is inserted into the cavity 4 whereby the slurry flow channel 5 is closed by the lower holding plate 9*b* as shown in FIG. 6B. A prescribed pressurizing fluid is fed from its source to the inside of the pressing member 81 through the connector 9*d* and, at the same time, the cavity 4 is evacuated by suction thereby unfolding the pleated pressing member 81. The feed of the pressurizing fluid is further continued to inflate the inflatable pressing member 81 to press the pulp layer 7 onto the wall of the cavity 4. The inflated pressing member 81 has a similar figure to the cavity 4.

Figure 6C:
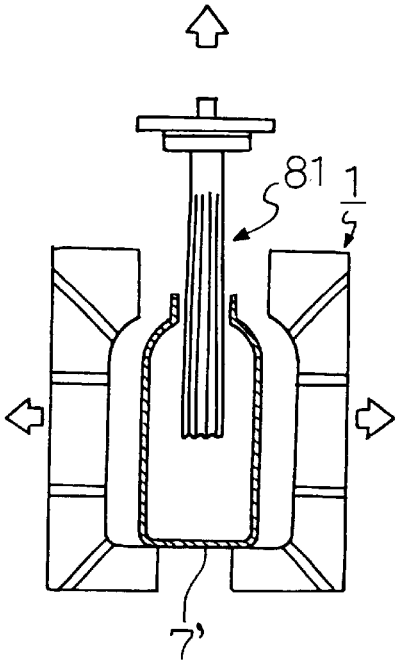
FIG. 6C, the step of opening the mold and removing the preform from the mold.

On sufficiently transferring the shape of the cavity 4 to the pulp layer 7 and reducing the water content of the pulp layer 7 to a prescribed level, the pressurizing fluid is withdrawn, and the pressing member 81 is further evacuated by suction, as shown in FIG. 6C. As a result, the pressing member 81 shrinks and returns to the initial pleated state. The pressing member 81 as pleated is taken out of the cavity 4. Since the pressing member 81 as pleated is of the same size as before being inserted into the cavity 4, it can be taken out without touching the opening 7*a* so that the pulp thereof can be prevented from falling off.

In the sixth embodiment, a cylindrical member of prescribed length having in the inside thereof a pressing member in its smallest size is inserted into the slurry flow channel of a paper making mold, and then the pressing member in the cylindrical member is led into the cavity of the mold.

Figure 8A:
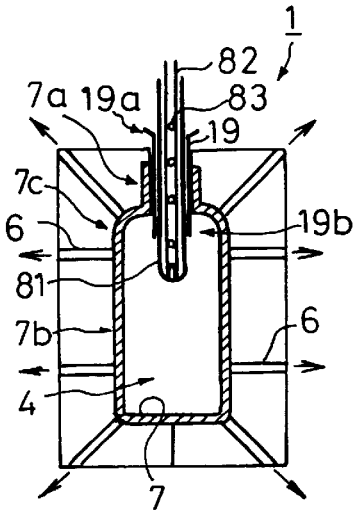
FIG. 8A is the step of inserting a cylindrical member.

More specifically, after formation of a pulp layer, as shown in FIG. 8A, a cylindrical member 19 of prescribed length which contains a pressing member 81 is inserted into the slurry flow channel 5 while evacuating the paper making mold 1 through the conduits 6. The cylindrical member 19 serves as a protecting member or an applicator so that the pressing member 81 is inserted into the cavity 4 without deforming or damaging the wet pulp layer 7.

The cylindrical member 19 has a circular cross section whose outer diameter is such that the cylindrical member 19 may not touch the pulp layer 7 when inserted into the slurry flow channel 5. The upper end 19*a* of the cylindrical member 19 has its diameter increased gradually toward the tip so that the pressing member 81 may be put therethrough easily.

On completing the insertion of the cylindrical member 19 into the slurry flow channel 5, the lower end 19*b* of the cylindrical member 19 is positioned near the shoulder 7*c* of the bottle-shaped pulp layer 7 which connects the opening 7*a* and the body 7*b*. Since the opening 7*a* with which the pressing member 81 is most likely to touch is protected by the cylindrical member 19 in this way, the pressing member 81 can be inserted into the pulp layer 7 efficiently without deforming or damaging the pulp layer 7.

In the same manner as in the fourth embodiment, the pressing member 81 has in the inside thereof a supporting member 82 comprising a cylindrical pipe, by which the pressing member 81 can be supported. The thus supported pressing member 81 is contained inside the cylindrical member 19. The pressing member 81 is evacuated by suction to have a smaller cross-sectional contour than that of the opening 7*a* and the cylindrical member 19. Similarly to the fourth embodiment, the supporting member 82 has a number of holes on its side wall.

It is preferred that a lubricating substance be applied between the cylindrical member 19 and the pressing member 81 to smooth the insertion of the pressing member 81 into the pulp layer 7. It is the most convenient and economical to use water used for forming the pulp layer 7 as the lubricating substance. Other substances are also applicable, for example, oily lubricants such as animal or vegetable oils and synthetic oils; polyhydric alcohols, such as liquid glycol and liquid glycerol; an aqueous solution or gel of natural polymers such as starch, gelatin, and agar, or synthetic polymers, such as polyvinyl alcohol, acrylic polymers, and urethane polymers; and particulate lubricants such as silica and polytetrafluoroethylene.

It is also effective for smooth insertion of the pressing member 81 into the pulp layer 7 that the contact surface of the cylindrical member 19 with the pressing member 81 be made of a material having a small coefficient of friction with the pressing member 81 such as polyethylene, polypropylene, polytetrafluoroethylene, silicone compounds, and fluorine-containing compounds or that the surface be treated with such a material or a composition comprising the material.

Figure 8B:
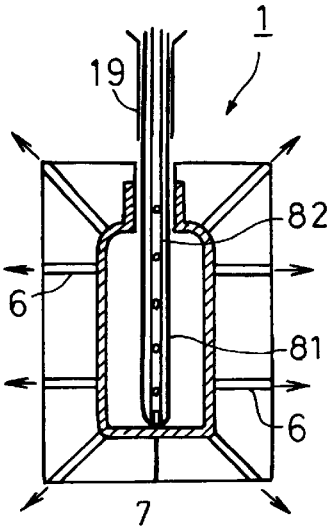
FIG. 8B, the step of inserting a pressing member and withdrawing the cylindrical member.

On completing the insertion of the cylindrical member 19 into the slurry flow channel 5, the cylindrical member 19 is drawn up and removed from the mold 1, and the pressing member 81 is inserted into the pulp layer 7 as shown in FIG. 8B. Inserting the pressing member 81 and drawing the cylindrical member 19 can be carried out simultaneously, or inserting the pressing member 81 may be followed by drawing the cylindrical member 19.

The pressing member 81 is inserted into the pulp layer 7 while supported by the supporting member 82. On completion of the insertion, the lower end of the pressing member 81 is positioned near the bottom of the pulp layer 7 as shown in FIG. 8B.

Figure 8C:
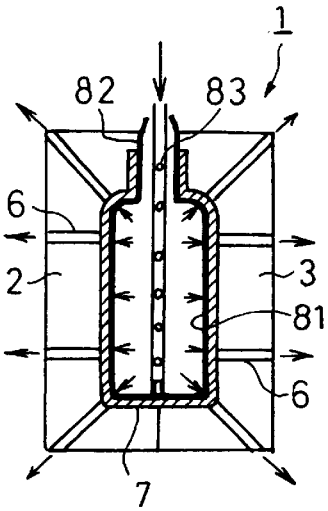
FIG. 8C, the step of pressing and dehydration.

As shown in FIG. 8C, a pressurizing fluid is fed to the inside of the supporting member 82. The fluid fed passes through the holes 83 formed on the side wall of the supporting member 82 and supplied to the inside of the pressing member 81. Simultaneously with the pressurizing fluid feed, the inside of the split molds 2 and 3 is evacuated by suction from the outside, whereby the pressing member 81 is inflated to press and dehydrate the pulp layer 7.

The seventh embodiment is for the most part similar to the sixth embodiment. The difference is that: in the sixth embodiment the pressing member 81 having been made small is placed inside the cylindrical member 19 and then inserted into the pulp layer 7, whereas in the seventh embodiment insertion of only the cylindrical member 19 is inserted into the slurry flow channel 5 and then the pressing member 81 having been made small is inserted into the pulp layer 7 through the cylindrical member 19, followed by inflating the pressing member 81 by feeding a pressurizing fluid thereto. Similarly to the sixth embodiment, the pressing member 81 can be inserted into the pulp layer 7 efficiently without deforming or damaging the pulp layer 7 in this embodiment.

It is another example of the seventh embodiment that, simultaneously with the insertion of the cylindrical member 19 of prescribed length into the slurry flow channel 5, the pressing member 81 having been made small is inserted into the cavity 4 through the cylindrical member 19.

The present invention is not limited to the above-described embodiments, and various changes and modifications can be made therein. For example, folding contour of the pressing member 81 according to the fifth embodiment can be changed in conformity with the shape of the cavity 4.

Figure 9:
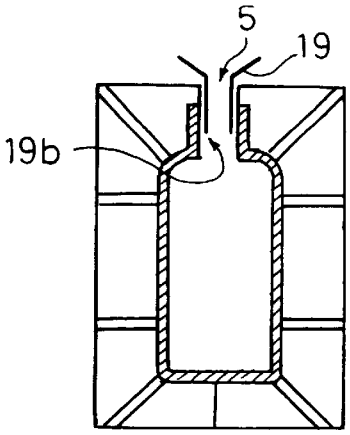
FIG. 9 (corresponding to FIG. 8A) shows another manner of inserting a cylindrical member in the sixth and seventh embodiments.

While, in the sixth and seventh embodiments, evacuation by suction is adopted as a means for making the pressing member 81 smaller, this means can be replaced by twisting the pressing member 81 around the supporting member 82 or folding the pressing member 81 into a prescribed contour. While, in the sixth and seventh embodiments, the cylindrical member 19 is inserted into the slurry flow channel 5 until its lower end 19*b* is positioned near the shoulder 7*c* of the bottle-shaped pulp layer 7, the insertion of the cylindrical member 19 may be stopped when the lower end 19*b* reaches the middle of the slurry flow channel 5 as illustrated in FIG. 9, which depends on the desired shape of the molded article. It is also conceivable that the cylindrical member 19 is inserted until the lower end 19*b* comes down near the bottom of the pulp layer 7. The form of the cylindrical member 19 is not limited to that used in the above-described embodiments as long as it neither deforms nor damages the pulp layer 7 and causes no difficulties in the insertion of the pressing member 81.

While the process of the present invention is suited to the production of bottle-shaped molded articles having the opening whose cross-sectional contour is smaller than that of the body, it is also applicable to production of other-shaped molded articles, such as carton boxes with a wide opening.

Where the process of the present invention is applied to the production of wide-mouthed pulp molded articles having such a shape that does not require the pressing member 81 to have so high inflatability, the pressing member 81 is only required to have flexibility to be folded and unfolded or twisted or untwisted, with no elastic stretchability being required. In such a case, the pressing member 81 may be of polyethylene, polypropylene, and the; like.

The tooling, such as the pressing member, used in the pulp making step and in the heating and drying step may be of different shapes and/or materials.

If desired, a resin layer, a coated layer, etc. can be provided on the outer and/or inner surfaces of the molded article 20 to enhance the strength of the molded article 20 or to prevent leakage of contents or for a decorative purpose.

It is also possible to provide the portion of the molded article 20 where a load is imposed in use, for example, the mouth 21 or the bottom 23, with a reinforcing member made of resins, etc. to improve the endurance. Further, these portions can be partly made of resins. The mouth 21 of the molded article 20 can have a polygonal section.

The process of the present invention is applicable to production of not only hollow articles used as containers but ornamental objects.

Where the pressing member 81 having no air-permeability is used in the aforementioned embodiments, it is possible to prevent the pressurizing fluid from partly remaining inside the pressing member 81 by evacuating the pressing member 81 by suction when the pressurizing fluid is withdrawn from the inside of the pressing member 81 after it presses the pulp layer 7 towards the inner wall of the cavity 4.

While the step of forming and dehydrating and the step of heating and drying are performed in separate molds in the aforementioned embodiments, these steps may be conducted in the same mold. That is, the wet pulp layer may be heat-dried simultaneously with the dehydration by heating the mold without taking out of the pulp layer therefrom.

While the paper-making split mold used in the aforementioned embodiments is composed of two split molds, it may be constructed of three or more blocks. The same applies to the heating mold.

The cavity shape of the paper making mold is not particularly limited in the aforementioned embodiments as far as the cavity shape of the heating mold is in conformity with a desired outer shape of pulp molded articles.

In the second and the third embodiments, while the opening 7*a* of the preform 7 is made to have a higher water content after dehydration, the step of dehydration may be designed so that any other part of the preform onto which a complicated surface profile of the cavity wall is to be transferred may have a higher water content. For example, in case where such patterns as letters, figures or symbols are to be made in relief on the body of a pulp molded article, dehydration is carried out in such a manner that the water content of the body of the preform may be higher than the other parts of the preform.

The aforementioned embodiments are interchangeable.

According to the process of the present invention, pulp molded articles of complicated shape having no butt-seam on their surfaces can be obtained. The present invention is especially effective in the production of hollow molded articles having an opening whose cross-sectional area is smaller than that of the body.

In particular, where an air-permeable pressing member is used, dehydration of the molded article can be achieved with simple equipment at high efficiency without leaving the trace of the paper-making net on the surface of the molded article.

Where the pulp layer formed by paper making is pressed with a pressing member in such a manner that a prescribed part of the pulp layer is pressed under a lower force than the other part, the drying efficiency of the pulp layer is improved, and the shape of the cavity wall of the mold can be transferred to that prescribed part of the pulp layer with improved precision.

Where a cylindrical member is used in combination with the pressing member, protection of the pulp layer against deformation or damage during the step of pressing and dehydration can be further ensured.

The present invention will now be illustrated in greater detail with reference to Examples.

EXAMPLE 1

A bottle-shaped preform was formed, pressed and dehydrated by use of the pressing member shown in FIG. 2 in accordance with the procedures illustrated in FIG. 1. The material and air-permeability of the inflatable pressing member used for pressing and dehydration are shown in Table 1 below. Pressing and dehydration were carried out for 15 seconds by feeding air (initial pressure: 300 kPa) to the pressing member. The water content of the molded article before pressing and dehydration was 77%. The water content of the pressed and dehydrated preform was as shown in Table 1.

TABLE 1

| | Pressing Member | | |
|---|---|---|---|
| | Material | Air Permeability (sec) | Water Content (%) |
| Example 1 | bag made of fabric of thermoplastic fibers | 280 | 60 |

EXAMPLE 2

A bottle-shaped preform was formed, pressed and dehydrated by use of the same pressing member as used in Example 1 in accordance with the procedures illustrated in FIG. 1. The pressing and dehydrating conditions were the same as in Example 1. The water content of the pressed and dehydrated preform was 60%.

The preform was taken out of the paper making mold and set in a heating mold heated to 200° C. A pressing member shown in FIG. 2 was inserted into the preform and superheated vapor at 220° C. was fed into the pressing member to heat and dry the preform. The material and air-permeability of the pressing member used are shown in Table 1. The time required for the water content of the preform to reduce to 20% is shown in Table 2.

TABLE 2

| | Pressing Member | Time (sec) |
|---|---|---|
| Example 2 | the same as in Example 1 | 30 |

This application claims the priority of Japanese Patent Application Nos. 11-40523 and 11-40524 both filed Feb. 18, 1999 which are incorporated herein by reference.

What is claimed is:

1. A process for producing a pulp molded article having an opening, comprising the steps of forming a pulp layer on an inner wall of a mold cavity, and drying the pulp layer, wherein said forming step comprises:

twisting a hollow inflatable pressing member having an end fixed to a supporting member, around said supporting member inserted in said pressing member so as to compact the hollow inflatable pressing member to be smaller in cross-sectional contour than that of the portion of the pulp layer corresponding to the opening of said pulp molded article;

inserting said pressing member into the pulp layer; and feeding a pressurizing fluid to the inside of the inserted pressing member to inflate said pressing member thereby to press the pulp layer onto the inner wall of the cavity.

2. A process according to claim 1, wherein said supporting member is a cylindrical pipe having a large number of annular guide idlers fitted therearound with clearance for rotation.

3. A process according to claim 1, wherein said pressing member has a projection of prescribed shape at the bottom of the inner side thereof, and said projection is fitted into the lower end of said supporting member.

4. A process according to claim 1, wherein said pressing the pulp layer with said pressing member is carried out in such a manner that a prescribed part of said pulp layer is pressed under a lower pressing force than the other part.

5. A process according to claim 4, wherein a protecting member is provided on said prescribed part of the pulp layer for lessening the pressing force of said pressing member onto said prescribed part.

6. A process for producing a pulp molded article having an opening, comprising the steps of forming a pulp layer on an inner wall of a mold cavity, and drying the pulp layer, wherein said forming step comprises:

twisting a hollow inflatable pressing member having air permeability and having an end fixed to a supporting member around said supporting member inserted in said pressing member so as to compact the hollow inflatable pressing member to be smaller in cross-sectional contour than that of the portion of the pulp layer corresponding to the opening of said pulp molded article;

inserting said pressing member into the pulp layer; and feeding a pressurizing fluid to the inside of the inserted pressing member to inflate said pressing member thereby to press the pulp layer onto the inner wall of the cavity.

7. A process for producing a pulp molded article having an opening, comprising the steps of forming a pulp layer on an inner wall of a mold cavity, and drying the pulp layer, wherein said forming step comprises:

twisting a hollow inflatable pressing member having an end fixed to a supporting member, around said supporting member inserted in said pressing member so as to compact the hollow inflatable pressing member to be smaller in cross-sectional contour than that of the portion of the pulp layer corresponding to the opening of said pulp molded article, wherein said supporting member has a large number of holes on its side wall;

inserting said pressing member into the pulp layer; and feeding a pressurizing fluid to the inside of said supporting member and supplying said fluid to the inside of said pressing member through said holes to inflate said pressing member thereby to press the pulp layer onto the inner wall of the cavity.

8. A process for producing a pulp molded article having an opening, comprising the steps of forming a pulp layer on an inner wall of a mold cavity, and drying the pulp layer, wherein said forming step comprises:

pleating said pressing member to make a number of folds along the insertion direction when said pressing member is inserted into said cavity so as to compact the hollow inflatable pressing member to be smaller cross-sectional contour than that of the portion of the pulp layer corresponding to the opening of said pulp molded article; and feeding a pressurizing fluid to the inside of the inserted pressing member to inflate said pressing member thereby to press the pulp layer onto the inner wall of the cavity.

9. A process according to claim 8, wherein said pressing member is folded in such a manner that radial pleats are formed in the cross-sectional contour of said pressing member.

10. A process for producing a pulp molded article having an opening, comprising the steps of forming a pulp layer on an inner wall of a mold cavity, and drying the pulp layer, wherein said forming step comprises:

evacuating by suction a hollow inflatable pressing member having an end fixed to a supporting member, around said supporting member inserted in said pressing member so as to compact the hollow inflatable pressing member to be smaller in cross-sectional contour than that of the portion of the pulp layer corresponding to the opening of said pulp molded article;

inserting said pressing member into the pulp layer; and feeding a pressurizing fluid to the inside of the inserted pressing member to inflate said pressing member thereby to press the pulp layer onto the inner wall of the cavity.

11. A process for producing a pulp molded article having an opening, comprising the steps of forming a pulp layer on an inner wall of a mold cavity, and drying the pulp layer, wherein said forming step comprises:

connecting a slurry flow channel in the mold to said cavity through which a pulp slurry is charged from the outside;

pressing and twisting a hollow inflatable pressing member so as to compact the pressing member by inserting the pressing member a cylindrical member of prescribed length so as to be smaller in cross-sectional contour than that of the portion of the pulp layer corresponding to the opening of said pulp molded article;

inserting said cylindrical member into said slurry flow channel;

inserting said pressing member in said cylindrical member into the pulp layer; and feeding a pressurizing fluid to the inside of the inserted pressing member to inflate said pressing member thereby to press the pulp layer onto the inner wall of the cavity.

12. A process for producing a pulp molded article having an opening, comprising the steps of forming a pulp layer on an inner wall of a mold cavity, and drying the pulp layer, wherein said forming step comprises:

connecting a slurry flow channel in the mold to said cavity through which a pulp slurry is charged from the outside;

inserting a cylindrical member of prescribed length into said slurry flow channel;

inserting a pressing member which has been compacted so as to be smaller in cross-sectional contour than that of the cylindrical member into said mold cavity through said cylindrical member; and feeding a pressurizing fluid to the inside of the inserted pressing member to inflate said pressing member thereby to press the pulp layer onto the inner wall of the cavity.

13. A process for producing a pulp molded article having an opening, comprising the steps of forming a pulp layer on the inner wall of a mold cavity, and drying the pulp layer, wherein said forming step comprises:

connecting a slurry flow channel in the mold to said cavity through which a pulp slurry is charged from the outside;

inserting a cylindrical member of prescribed length, into which a pressing member which has been compacted so as to be smaller in cross-sectional contour than that of the cylindrical member has been inserted, into said slurry flow channel; and feeding a pressurizing fluid to the inside of the inserted pressing member to inflate said pressing member thereby to press the pulp layer onto the inner wall of the cavity.

14. An apparatus for producing a pulp molded article having an opening, comprising means for forming a pulp layer on an inner wall of a mold cavity, and means for drying the pulp layer, wherein said means for forming comprises:

means for twisting a hollow inflatable pressing member having an end fixed to a supporting member, around said supporting member inserted in said pressing member so as to compact the hollow inflatable pressing member to be smaller in cross-sectional contour than that of the portion of the pulp layer corresponding to the opening of said pulp molded article;

means for inserting said pressing member into the pulp layer; and means for feeding a pressurizing fluid to the inside of the inserted pressing member to inflate said pressing member thereby to press the pulp layer onto the inner wall of the cavity.

15. An apparatus for producing a pulp molded article having an opening, comprising means for forming a pulp layer on an inner wall of a mold cavity, and means for drying the pulp layer, wherein said means for forming comprises:

means for twisting a hollow inflatable pressing member having air permeability and having an end fixed to a supporting member, around said supporting member inserted in said pressing member so as to compact the hollow inflatable pressing member to be smaller in cross-sectional contour than that of the portion of the pulp layer corresponding to the opening of said pulp molded article;

means for inserting said pressing member into the pulp layer; and means for feeding a pressurizing fluid to the inside of the inserted pressing member to inflate said pressing member thereby to press the pulp layer onto the inner wall of the cavity.

16. An apparatus for producing a pulp molded article having an opening, comprising means for forming a pulp layer on an inner wall of a mold cavity, and means for drying the pulp layer, wherein said means for forming comprises:

means for twisting a hollow inflatable pressing member having an end fixed to a supporting member around said supporting member inserted in said pressing member so as to compact the hollow inflatable pressing member to be smaller in cross-sectional contour than that of the portion of the pulp layer corresponding to the opening of said pulp molded article, wherein said supporting member has a large number of holes on its side wall;

means for inserting said pressing member into the pulp layer; and means for feeding a pressurizing fluid to the inside of said supporting member and supplying said fluid to the inside of said pressing member through said holes to inflate said pressing member thereby to press the pulp layer onto the inner wall of the cavity.

17. An apparatus for producing a pulp molded article having an opening, comprising means for forming a pulp layer on an inner wall of a mold cavity, and means for drying the pulp layer, wherein said means for forming comprises:

means for pleating said pressing member to make a number of folds along the insertion direction when said pressing member is inserted into said cavity so as to compact the hollow inflatable pressing member to be smaller cross-sectional contour than that of the portion of the pulp layer corresponding to the opening of said pulp molded article; and means for feeding a pressurizing fluid to the inside of the inserted pressing member to inflate said pressing member thereby to press the pulp layer onto the inner wall of the cavity.

18. An apparatus for producing a pulp molded article having an opening, comprising means for forming a pulp layer on an inner wall of a mold cavity, and means for drying the pulp layer, wherein said means for forming comprises:

means for evacuating by suction a hollow inflatable pressing member having an end fixed to a supporting member around said supporting member inserted in said pressing member;

means for inserting said pressing member into the pulp layer; and means for feeding a pressurizing fluid to the inside of the inserted pressing member to inflate said pressing member thereby to press the pulp layer onto the inner wall of the cavity.

19. An apparatus for producing a pulp molded article having an opening, comprising means for forming a pulp layer on an inner wall of a mold cavity, and means for drying the pulp layer, wherein said means for forming comprises:

means for connecting a slurry flow channel in the mold to said cavity through which a pulp slurry is charged from the outside;

means for pressing and twisting a hollow inflatable pressing member so as to compact the pressing member by inserting the pressing member a cylindrical member of prescribed length so as to be smaller in cross-sectional contour than that of the portion of the pulp layer corresponding to the opening of said pulp molded article;

means for inserting said cylindrical member into said slurry flow channel;

means for inserting said pressing member in said cylindrical member into the pulp layer; and means for feeding a pressurizing fluid to the inside of the inserted pressing member to inflate said pressing member thereby to press the pulp layer onto the inner wall of the cavity.

20. An apparatus for producing a pulp molded article having an opening, comprising means for forming a pulp layer on an inner wall of a mold cavity, and means for drying the pulp layer, wherein said means for forming comprises:

means for connecting a slurry flow channel in the mold to said cavity through which a pulp slurry is charged from the outside;

means for inserting a cylindrical member of prescribed length into said slurry flow channel;

means for inserting a pressing member which has been compacted so as to be smaller in cross-sectional contour than that of the cylindrical member into said mold cavity through said cylindrical member; and means for feeding a pressurizing fluid to the inside of the inserted pressing member to inflate said pressing member thereby to press the pulp layer onto the inner wall of the cavity.

21. An apparatus for producing a pulp molded article having an opening, comprising means for forming a pulp layer on the inner wall of a mold cavity, and means for drying the pulp layer, wherein said means for forming comprises:

means for connecting a slurry flow channel in the mold to said cavity through which a pulp slurry is charged from the outside;

means for inserting a cylindrical member of prescribed length, into which a pressing member which has been compacted so as to be smaller in cross-sectional contour than that of the cylindrical member has been inserted, into said slurry flow channel; and means for feeding a pressurizing fluid to the inside of the inserted pressing member to inflate said pressing member thereby to press the pulp layer onto the inner wall of the cavity.

* * * * *